US005746933A

United States Patent [19]

Ishida et al.

[11] Patent Number: 5,746,933

[45] Date of Patent: May 5, 1998

[54] LUBRICATING OIL AND COMPOSITION FOR REFRIGERATING MACHINE, AND REFRIGERATING MACHINE

[75] Inventors: Noboru Ishida; Umekichi Sasaki; Katsuya Takigawa; Satoshi Suda, all of Yokohama, Japan

[73] Assignee: Nippon Oil Co., Ltd., Tokyo, Japan

[21] Appl. No.: 552,540

[22] Filed: Nov. 3, 1995

[30] Foreign Application Priority Data

Nov. 7, 1994 [JP] Japan ..... 6-296029

[51] Int. Cl.[6] ..... C09K 5/04; C10M 171/00; C10M 107/34

[52] U.S. Cl. ..... 252/68; 508/304; 508/307; 508/579; 508/583; 536/120; 536/4.1; 549/346; 549/417; 549/477; 549/510; 549/554

[58] Field of Search ..... 252/68; 508/304, 508/307, 579, 583; 536/120, 4.1; 549/346, 417, 477, 510, 554

[56] References Cited

U.S. PATENT DOCUMENTS 5,080,816 1/1992 Sakamoto et al. .
5,202,044 4/1993 Hagihara et al. ..... 252/68

FOREIGN PATENT DOCUMENTS

A0460613 4/1991 European Pat. Off. .
460614 12/1991 European Pat. Off. .

OTHER PUBLICATIONS

Derwent Abstract 92–076414 for JP 4–20596, Jan. 1992.
JPO abstract for JP 3–70794, Mar. 1991.

*Primary Examiner*—Alan Diamond

*Attorney, Agent, or Firm*—The Morrison Law Firm

[57] ABSTRACT

A lubricating oil for refrigerating machines comprises polyoxyalkylene compounds represented by the formula (I):

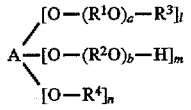

(I)

Wherein A is a residue obtained from a compound which has both a heterocyclic ring having an ether linkage therein and hydroxyl groups by eliminating the hydroxyl groups from the compound; $R^1$ and $R^2$ are each an alkylene group; $R^3$ is an alkyl group; $R^4$ is hydrogen atom or an alkyl group; a and b are each a positive integer and l, m, and n are each an integer of 0 or more; and a·l+b·m=2 to 100 and l+m+n=2 to 20; further, the polyoxyalkylene compounds have a hydroxyl value ranging from 0 to 30.0 mgKOH/g and satisfies the following formula (1)

$$0.5<p/(p+q)<1.0 \quad (1)$$

wherein p is the number of butylene groups represented by $R^1$ and $R^2$, and q is the number of all alkylene groups excluding the butylene groups.

9 Claims, No Drawings

LUBRICATING OIL AND COMPOSITION FOR REFRIGERATING MACHINE, AND REFRIGERATING MACHINE

BACKGROUND OF THE INVENTION

1. Field of the Invention

This invention relates to a lubricating oil for a refrigerating machine, a composition for a refrigerating machine and a refrigerating machine. In particular, it relates to such a lubricating oil which is useful as a refrigerating machine oil for particular use with an alkane fluoride refrigerant and/or alkane chlorofluoride refrigerant, such a composition comprising a mixture of said lubricating oil with the alkane fluoride and/or alkane chlorofluoride refrigerant, and a refrigerating machine wherein the lubricating oil mentioned above is used as such, and an alkane fluoride and/or alkane chlorofluoride is used as a refrigerant.

2. Prior Art

In view of the recent problems as to the destruction of the ozone layer, CFC (chlorofluorocarbon) and HCFC (hydrochlorofluorocarbon) which have conventionally been used as a refrigerant for a refrigerating machine is now restricted in use. Therefore, as a replacement of these refrigerants, HFC (hydrofluorocarbon) has been increasingly employed as a refrigerant.

Under the circumstances, PAG (polyalkylene glycol) and esters which are compatible with HFC have been proposed or used as an oil for a refrigerating machine using an HFC refrigerant. For example, the use of PAG is proposed in U.S. Pat. No. 4,755.316; Japanese Pat. Appln. Laid-Open Gezettes Nos. Hei 1-198694, Hei 1-256594, Hei 1-259093, Hei 1-259094, Hei 1-259095, Hei 1-274191, Hei 2-43290, Hei 2-55791 and Hei 2-84491. The use of such esters is proposed in PCT. Publication No. Hei 3-505602 and in Japanese Pat. Appln. Laid-Open Gazettes Nos. Hei 3-88892, Hei 2-128991, Hei 3-128992, Hei 3-200895, Hei 3-227397, Hei 4-20597, Hei 4- 72390, Hei 4-218592 and Hei 4-249593.

Since PAG is, however, high in hygroscopicity and poor in electric characteristics (volume resistivity), it is likely to cause electrical leakage when it is used in a closed type compressor having a structure where a refrigerating machine oil is allowed to contact with an electrode as in the case of a refrigerator or a room air conditioner.

In view of this, an ester-based oil may be useful as a refrigerating machine oil for the closed type compressor using an HFC refrigerant since the ester-based oil is compatible with the HFC, low in hygroscopicity and excellent in electric characteristics. However, it is possible that the ester-based oil is hydrolyzed due to its specific structure thereby to generate an acid thus causing various inconveniences.

In contrast, the employment of PAG having low water absorbency and high volume resistivity is proposed as described in Japanese Pat. Appln. Laid-Open Gazettes Nos. Hei 4-15295, Hei 4-39394 and Hei 4-130188. However, the PAG also fails to fully meet all of the requirements such as excellent compatibility with HFC, low hygroscopicity and excellent electric insulation.

SUMMARY OF THE INVENTION

An object of the present invention is to provide a lubricating oil for refrigerating machines which is excellent in compatibility with an alkane fluoride refrigerant such as HFC-134a and/or an alkane chlorofluoride refrigerant and is also excellent in electric characteristics.

Another object of the present invention is to provide a composition for refrigerating machines which comprises a mixture of the above-mentioned lubricating oil with an alkane fluoride refrigerant and/or an alkane chlorofluoride refrigerant.

A further object of the present invention is to provide a refrigerating machine wherein the lubricating oil mentioned above is used as a lubricating oil, and an alkane fluoride and/or alkane chlorofluoride is used as a refrigerant.

The present inventors took notice of an ether which will not be hydrolyzed and made an extensive study to finally find out that a polyoxyalkylene compound having a specific structure is soluble with HFC over a wide range of temperature, and is excellent in electric characteristics. This invention is based on this finding.

The lubricating oil for refrigerating machines of the present invention is characterized in that it comprises as a main component at least one compound selected from the group consisting of polyoxyalkylene compounds represented by the following general formula (I)

$$A\begin{cases}[O-(R^1O)a-R^3]_l \\ [O-(R^2O)b-H]_m \\ [O-R^4]_n\end{cases} \quad (I)$$

wherein A represents a residue (or moiety) obtained from a compound of 4–40 carbon atoms which has both a heterocyclic ring having an ether linkage and 2 to 20 hydroxyl groups in the molecule by eliminating said hydroxyl groups from said compound; $R^1$ and $R^2$ may be identical with or different from each other and are each an alkylene group having 2 to 6 carbon atoms; $R^3$ is an alkyl group having 1 to 6 carbon atoms; $R^4$ is hydrogen atom or an alkyl group having 1 to 6 carbon atoms; a and b are each a positive integer and Q, m and n are each an integer of 0 or more with the proviso satisfying conditions of $a \cdot l + b \cdot m = 2$ to 100 and $l+m+n=2$ to 20; further, said main component simultaneously satisfying the following two conditions:

(a) said main component has a hydroxyl value ranging from 0 mgKOH/g to 30.0 mgKOH/g and (b) a ratio of butylene groups of all alkylene groups represented by $R^1$ and $R^2$ in the general formula (I) to said all alkylene groups satisfies the following formula (1).

$$0.5 \leqq p/(p+q) \leqq 1.0 \quad (1)$$

wherein "p" is the number of butylene groups, "q" is the number of alkylene groups having 2 to 6 carbon atoms excluding the butylene groups.

The composition for refrigerating machines of the present invention is characterized in that it comprises a mixture of:

(A) a lubricating oil for a refrigerating machine mentioned above and (B) an alkane fluoride and/or an alkane chlorofluoride.

The refrigerating machine of the present invention is one in which (B) an alkane fluoride and/or an alkane chlorofluoride is used as a refrigerant and which is characterized by using therein (A) the aforementioned lubricating oil as a lubricating oil.

This invention will be explained in more detail.

Polyoxyalkylene compounds used in this invention are those represented by the following general formula (I):

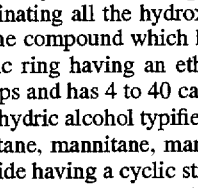

(I)

wherein A represents a residue (or moiety) obtained from a compound which has in the molecule both a heterocyclic ring having an ether linkage and 2 to 20, preferably 2 to 15, more preferably 2 to 10 hydroxyl groups, and has 4 to 40, preferably 5 to 30, more preferably 5 to 20 carbon atoms, by eliminating all the hydroxyl groups from said compound.

The compound which has in the molecule both a heterocyclic ring having an ether linkage and 2 to 20 hydroxyl groups and has 4 to 40 carbon atoms, includes a dehydrated polyhydric alcohol typified by isosorbide (1,4-3,6-sorbide-), hexitane, mannitane, mannide, dulcitane or dulcide; a saccharide having a cyclic structure, typified by a monosaccharide such as xylose, arabinose, ribose, rhamnose, glucose, fructose, galactose, mannose or sorbose; a disaccharide such as cellobiose, maltose, isomaltose, trehalose or sucrose; or a trisaccharide such as raffinose, gentianose or melezitose.

If the residue represented by A in the general formula (I) does not meet the aforesaid conditions, such a polyoxyalkylene compound is not preferable because of its poor compatibility with a refrigerant which is an alkane fluoride and/or alkane chlorofluoride.

$R^1$ and $R^2$ in the general formula (I) may be identical with or different from each other, and are each an alkylene group having 2 to 6 carbon atoms. If $R^1$ and $R^2$ of a polyoxyalkylene compound in the general formula (I) are each an alkylene group having 7 or more carbon atoms, such a polyoxyalkylene compound is not preferable because of its poor compatibility with a refrigerant which is an alkane fluoride and/or alkane chlorofluoride.

Examples of $R^1$ and $R^2$ are each an ethylene group, propylene group (1-methylethylene group, 2-methylethylene group), trimethylene group, butylene group (1-ethylethylene group, 2-ethylethylene group), 1,2-dimethylethylene group, 2,2-dimethylethylene group, 1-methyltrimethylene group, 2-methyltrimethylene group, 3-methyltrimethylene group, tetramethylene group, pentylene group (1-propylethylene group, 2-propylethylene group), 1ethyl-1-methylethylene group, 1-ethyl-2-methylethylene group, 1,1,2-trimethylethylene group, 1,2,2-trimethylethylene group, 1-ethyltrimethylene group, 2-ethyltrimethylene group, 3-ethyltrimethylene group, 1,1-dimethyltrimethylene group, 1,2-dimethyltrimethylene group, 1,3-dimethyltrimethylene group, 2,3-dimethyltrimethylene group, 3,3-dimethyltrimethylene group, 1-methyltetramethylene group, 2-methyltetramethylene group, 3-methyltetramethylene group, 4-methyltetramethylene group, pentamethylene group, hexylene group (1-butylethylene group, 2-butylethylene group), 1-methyl1-propylethylene group, 1-methyl-2-propylethylene group, 2-methyl-2-propylethylene group, 1,1-diethylethylene group, 1,2-diethylethylene group, 2,2-diethylethylene group, 1-ethyl-1,2-dimethylethylene group, 1-ethyl-2,2-dimethylethylene group, 2-ethyl-1,1-dimethylethylene group, 2-ethyl-1,2-dimethylethylene group, 1,1,2,2-tetramethylethylene group, 1-propyltrimethylene group, 2-propyltrimethylene group, 3-propyltrimethylene group, 1-ethyl-1-methyltrimethylene group, 1-ethyl-2-methyltrimethylene group, 1-ethyl-3-methyltrimethylene group, 2-ethyl-1-methyltrimethylene group, 2-ethyl-2-methyltrimethylene group, 2-ethyl-3-methyltrimethylene group, 3-ethyl-1-methyltrimethylene group, 3-ethyl-2-methyltrimethylene group, 3-ethyl-3-methyltrimethylene group, 1,1,2-trimethyltrimethylene group, 1,1,3-trimethyltrimethylene group, 1,2,2-trimethyltrimethylene group, 1,2,3-trimethyltrimethylene group, 1,3,3-trimethyltrimethylene group, 2,2,3-trimethyltrimethylene group, 2,3,3-trimethyltrimethylene group, 1-ethyltetramethylene group, 2-ethyltetramethylene group, 3-ethyltetramethylene group, 4-ethyltetramethylene group, 1,1-dimethyltetramethylene group, 1,2-dimethyltetramethylene group, 1,3-dimethyltetramethylene group, 1,4-dimethyltetramethylene group, 2,2-dimethyltetramethylene group, 2,3-dimethyltetramethylene group, 2,4-dimethyltetramethylene group, 3,3-dimethyltetramethylene group, 3,4-dimethyltetramethylene group, 4,4-dimethyltetramethylene group, 1-methylpentamethylene group, 2-methylpentamethylene group, 3-methylpentamethylene group, 4-methylpentamethylene group, 5-methylpentamethylene group and hexamethylene group.

Moreover, because of better compatibility with an alkane fluoride and/or alkane chlorofluoride refrigerant, $R^1$ and $R^2$ are preferably an alkylene group having 2 to 4 carbon atoms respectively. More preferably, they are each an alkylene group having 3 to 4 carbon atoms such as propylene (1-methylethylene, 2-methylethylene) group, trimethylene group, butylene (1-ethylethylene, 2-ethylethylene) group, 1,2-dimethylethylene group, 2,2-dimethylethylene group, 1-methyltrimethylene group, 2-methyltrimethylene group, 3-methyltrimethylene group and tetramethylene group.

Polyoxyalkylene groups represented by the general formulas $-(R^1O)a-$ and $-(R^2O)b-$ in the polyoxyalkylene compound represented by the general formula (I) in this invention may be individually the one consisting of a plurality of oxyalkylene groups of a single structure, or the one consisting of oxyalkylene groups of two or more kinds of structures, i.e., a random copolymer or a block copolymer of two or more kinds of alkylene oxides.

$R^3$ in the general formula (I) represents an alkyl group having 1 to 6, preferably 1 to 4, more preferably 1 to 3 carbon atoms. If $R^3$ of polyoxyalkylene compound in the general formula (I) is an alkyl group having 7 or more carbon atoms, alkenyl group or aryl group, such a polyoxyalkylene compound is not preferable because of its poor compatibility with a refrigerant which is an alkane fluoride and/or alkane chlorofluoride.

Examples of $R^3$ are methyl group, ethyl group, propyl group, isopropyl group, butyl group (including all isomers), pentyl group (including all isomers) and hexyl group (including all isomers).

$R^4$ in the general formula (I) represents hydrogen atom or an alkyl group having 1 to 6, preferably 1 to 4, more preferably 1 to 3 carbon atoms. If $R^4$ of polyoxyalkylene compound in the general formula (I) is an alkyl group having 7 or more carbon atoms, alkenyl group or aryl group, such a polyoxyalkylene compound is not preferable because of its poor compatibility with a refrigerant which is an alkane fluoride and/or alkane chlorofluoride.

Examples of $R^4$ are hydrogen atom, methyl group, ethyl group, propyl group, isopropyl group, butyl group (including all isomers), pentyl group (including all isomers) and hexyl group (including all isomers).

The symbols a and b are each a positive integer and l, m and n are each an integer of 0 or more in the general formula (I). These symbols satisfy conditions of $a \cdot l + b \cdot m = 2$ to 100, preferably 2 to 50, more preferably 2 to 30, most preferably 2 to 20, and $l+m+n=2$ to 20, preferably 2 to 15, more preferably 2 to 10.

The lubricating oil for refrigerating machines of this invention comprises as a main component at least one member selected from the group consisting of the polyoxyalkylene compounds represented by the general formula (I). It is important in this invention that the polyoxyalkylene compounds, whether used singly or in admixture, meet both of the following conditions or requirements (a) and (b) at the same time.

(a) The range of the hydroxyl value of a single member or a mixture of said compounds is between a lower limit of 0 mgKOH/g and an upper limit of 30.0 mgKOH/g, preferably 20.0 mgKOH/g.

(b) When the number of butylene groups is indicated by "p" and the number of alkylene group having 2 to 6 carbon atoms excludings the butylene groups is indicated by "q" among all of alkylene groups represented by $R^1$ and $R^2$ in the general formula (I), the value of p/(p+q) (i.e., a ratio of butylene groups to all alkylene groups represented by $R^1$ and $R^2$) is in the range of 0.5 to 1.0, preferably 0.7 to 1.0, more preferably 0.8 to 1.0, most preferably 1.0.

In this invention, the hydroxyl value indicated in the above (a) should ideally be 0 mgKOH/g. However, because of a difficulty to realize such a value in the actual manufacture of said compounds, the lower limit of the hydroxyl value would generally be 0.5 mgKOH/g or so. On the other hand, if the hydroxyl value of the above (a) exceeds 30.0 mgKOH/g, a polyoxyalkylene compound to be obtained would become undesirably poor in electric characteristics and lubricity.

Further, when a ratio of p/(p+q) of the above (b) is less than 0.5, it would be impossible to obtain a polyoxyalkylene compound which is excellent in both of compatibility with an alkane fluoride and/or alkane chlorofluoride constituting a refrigerant and electric characteristics.

A simple member or a mixture of the polyoxyalkylene compounds represented by the general formula (I) in this invention may be arbitrarily manufactured. Specifically, a compound comprising both a heterocyclic ring having an ether linkage and 2 to 20 hydroxyl groups in the molecule is reacted with an alkylating agent in the presence of a phase-transfer catalyst and at a temperature ranging from 0° C. to 100° C. In this case, one or more of such compounds comprising the heterocyclic ring and 2 to 20 hydroxyl groups may be used for alkylation with the alkylating agent. Further, the polyoxyalkylene compound thus obtained may be subjected to refining treatment for removing the by-products and unreacted substances if any, or may not be subjected to the refining treatment if the amount of these by-products or unreacted substances is small.

There is no perticular restriction on the molecular weight of the polyoxyalkylene compound or a mixture of the polyoxyalkylene compounds used in this invention. However, in view of enhancing the sealing performance of a compressor for a refrigerating machine, it is preferable to employ those having a number-average molecular weight (Mn) of 200 to 4,000, more preferably 300 to 3,000. Moreover, in view of improving the compatibility with an alkane fluoride and/or alkane chlorofluoride constituting a refrigerant, it is preferable to select those having a ratio of Mw (weight-average molecular weight)/Mn=1.0 to 1.2.

Moreover, the kinematic viscosity of the polyoxyalkylene compound or a mixture of the polyoxyalkylene compounds may be optional. However, in view of improving the compatibility with an alkane fluoride and/or alkane chlorofluoride constituting a refrigerant and lubricity, it is preferable to confine the kinematic viscosity to 3 to 2,000 $mm^2/s$, more preferably 5 to 1,500 $mm^2/s$ at a temperature of 40° C., and to 2 to 100 $mm^2/s$, more preferably 3 to 50 $mm^2/s$ at a temperature of 100° C.

The lubricating oil for a refrigerating machine of this invention comprises as a main component a polyoxyalkylene compound represented by the general formula (I) or a mixture of such polyoxyalkylene compounds. Accordingly, the polyoxyalkylene compound or compounds represented by the general formula (I) may be used singly without adding any other kinds of lubricants, or may be used in admixture with other kinds of lubricants if desired. In the latter case, the other kinds of lubricants that can be mixed into the polyoxyalkylene compound or compounds may be selected from oxygen-containing type lubricating oils for a refrigerating machine. The oxygen-containing type lubricating oils preferably include esters, polyglycol, polyphenyl ether, silicates, polysiloxane and perfluoroether with esters and polyglycol being more preferable.

Examples of the ester mentioned above are dibasic acid esters, polyol esters, complex esters and polyol carbonic esters.

Dibasic acid esters preferably used herein are an ester formed through a reaction between a dibasic acid having 5 to 10 carbon atoms such as glutaric acid, adipic acid, pimeric acid, suberic acid, azelaic acid or sebacic acid, and a straight- or branched-chain monohydric alcohol having 1 to 15 carbon atoms such as methanol, ethanol, propanol, butanol, pentanol, hexanol, heptanol, octanol, nonanol, decanol, undecanol, dodecanol, tridecanol, tetradecanenol or pentadecanol. Examples of such dibasic acid esters are ditridecyl glutarate, di 2-ethyl hexyl adipate, diisodecyl adipate, ditridecyl adipate and di 3-ethyl hexyl sebacate.

Polyol esters preferably used herein include an ester formed through a reaction between a diol or a polyol having 3 to 20 hydroxyl groups and a fatty acid having 6 to 20 carbon atoms. Examples of the diol are ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2diethyl-1,3-propanediol, 1,8-octanediol, 1,9-nonanediol, 1,10-decanediol, 1,11-undecanediol and 1,12-dodecanediol. Examples of the polyol are polyhydric alcohols such as trimethylol ethane, trimethylol propane, trimethylol butane, di-(trimethylol propane), tri-(trimethylol propane), pentaerythritol, di-(pentaerythritol), tri-(pentaerythritol), glycerol, polyglycerol (dimer to eicosamer of glycerol), 1,3,5-pentane triol, sorbitol, sorbitan, sorbitol-glycerol condensate, adonitol, arabitol, xylitol and mannitol, saccharides such as xylose, arabinose, ribose, rhamnose, glycose, fructose, galactose, mannose, sorbose, cellobiose, maltose, isomaltose, trehalose, sucrose, raffinose, gentianose, melezitose and partially etherified products thereof, and methyl glucoside (glycoside). Examples of the fatty acid are straight- or branched-chain ones such as hexane acid, heptane acid, octane acid, nonane acid, decane acid, undecane acid, dodecane acid, tridecane acid, tetradecane acid, pentadecane acid, hexadecane acid, heptadecane acid, octadecane acid, nonadecane acid, eicosane acid, oleic acid and so-called neo acid whose a carbon atom is quaternary. The polyol ester used herein may have free hydroxyl groups. Particularly preferable polyol ester is the one derived from a hindered alcohol such as neopentyl glycol, trimethylol ethane, trimethylol propane, trimethylol butane, di-(trimethylol propane), tri-(trimethylol propane), pentaerythritol, di-(pentaerythritol) or tri-(pentaerythritol). Examples of such polyol ester derived from the hindered alcohol are trimethylol propane caprylate, trimethylol propane pelargonate, pentaerythritol 2-ethylhexanoate and pentaerythritol pelargonate.

Complex esters used herein are an ester formed by reacting a fatty acid or dibasic acid with a monohydric alcohol or polyol. These acids and alcohols can be the same as illustrated in the explanations of the dibasic acid ester and polyol ester.

Polyol carbonic esters used herein are an ester formed through a reaction between a carbonic acid and a polyol. The polyol can be the same as illustrated in the explanation of the polyol ester, or be polyglycols prepared by homopolymerizing or copolymerizing diols or adducts prepared by the addition reaction of the above illustrated polyol with polyglycol.

The polyglycol preferably used herein is a polyalkylene glycol, an etherified product of the polyalkylene glycol or a modified compound thereof. The polyalkylene glycol used can be ones prepared by homopolymerizing or copolymerizing diols, and the diols can be the same as illustrated in the foregoing explanation of polyol esters. The products prepared by etherifying the hydroxyl groups of a polyalkylene glycol are useful. Examples of the etherified product of polyalkylene glycol are monomethyl ether, monoethyl ether, monopropyl ether, monobutyl ether, monopentyl ether, monohexyl ether, monoheptyl ether, monooctyl ether, monononyl ether, monodecyl ether, dimethyl ether, diethyl ether, dipropyl ether, dibutyl ether, dipentyl ether, dihexyl ether, diheptyl ether, dioctyl ether, dinonyl ether and didecyl ether. The modified compound of polyglycol includes an adduct prepared by addition reacting a polyol with a polyalkylene glycol, and etherified products of the adduct. The polyol used herein can be the same as illustrated in the foregoing explanation of the polyol ester. When the above mentioned polyalkylene glycol is prepared by copolymerizing the aforesaid alkylene diols of different structures, there is no restriction on the polymerization form of oxyalkylene groups, i.e., the polymerization may be random copolymerization or block copolymerization.

If the polyoxyalkylene compound or a mixture of the polyoxyalkylene compounds is mixed with the above-mentioned other oxygen-containing type lubricating oil for use as a lubricating oil for refrigerating machines according to this invention, the amount of the other oxygen-containing type lubricating oil mixed should be not more than 100 parts by weight, preferably not more than 40 parts by weight, per 100 parts by weight of the polyoxyalkylene compound or a mixture of the polyoxyalkylene compounds.

It is also possible according to this invention to mix a mineral oil-based lubricating oil or a hydrocarbon-based synthetic lubricating oil into the polyoxyalkylene compound or a mixture of the polyoxyalkylene compounds for use as a lubricating oil for refrigerating machines if desired.

Examples of the mineral oil-based lubricating oil that can be used in this case are paraffinic or naphthenic base oils which can be produced by subjecting a lubricating oil fraction obtained by the atmospheric or vacuum distillation of crude oils to a suitable combination of refining treatments such as solvent deasphalting, solvent extraction, hydrocracking, solvent dewaxing, catalytic dewaxing, hydrorefining, washing with sulfuric acid and clay treatment. On the other hand, examples of the hydrocarbon-based synthetic lubricating oil that can be used in this case are poly α-olefins (such as polybutene, 1-octene oligomer and 1-decene oligomer), an alkylbenzene, an alkylnaphthalene and a mixture thereof.

Since these mineral oil-based lubricating oil and hydrocarbon-based synthetic lubricating oil are relatively poor in compatibility with a hydrogen-containing halogenocarbon refrigerant, the amount of each of these oils should be not more than 40 parts by weight, preferably not more than 30 parts by weight, per 100 parts by weight of the polyoxyalkylene compound defined in the general formula (I) or a mixture of the polyoxyalkylene compounds.

In cases where the lubricating oil of this invention for a refrigerating machine is formed of the polyoxyalkylene compound (or a mixture of the polyoxyalkylene compounds) according to this invention, an oxygen-containing type lubricating oil, a mineral oil-based lubricating oil and a hydrocarbon-type synthetic lubricating oil, the kinematic viscosity of the lubricating oil to be so formed may be arbitrarily predetermined. However, in view of improving the sealing performance and heat transfer efficiency of the compressor for the refrigerating machine, it is preferable for the lubricating oil so formed to have a kinematic viscosity of 3 to 2,000 $mm^2/s$, more preferably 5 to 1,500 $mm^2/s$ at a temperature of 40° C., and of 2 to 100 $mm^2/s$, more preferably 3 to 50 $mm^2/s$ at a temperature of 100° C.

In order to enable a refrigerating machine to be further improved in wear resistance and load resistance, it is possible to blend the lubricating oil for refrigerating machine (the oil being hereinafter sometimes referred to as "the refrigerating machine oil" for convenience' sake) of this invention with at least one kind of a phosphorus compound selected from the group consisting of phosphoric esters, acid phosphoric esters, amine salts of acid phosphoric esters, chlorinated phosphoric esters and phosphorous esters.

These phosphorus compounds are esters obtained by a reaction between phosphoric acid or phosphorous acid and an alkanol or a polyether type alcohol, or are derivatives of the esters.

The phosphoric esters used herein include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylyl phosphate, cresyldiphenyl phosphate and xylyldiphenyl phosphate.

The acid phosphoric esters used herein include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dioctadecyl acid phosphate and dioleyl acid phosphate. Examples of amine salt of acid phosphoric ester are methyl amine, ethyl amine, propyl amine, butyl amine, pentyl amine, hexyl amine, heptyl amine, octyl amine, dimethyl amine, diethyl amine, dipropyl amine, dibutyl amine, dipentyl amine, dihexyl amine, diheptyl amine, dioctyl amine, trimethyl amine, triethyl amine, tripropyl amine, tributyl amine, tripentyl amine, trihexyl amine, triheptyl amine and trioctyl amine of the acid phosphoric ester. Examples of chlorinated phosphoric ester are tris-dichloropropyl phosphate, tris-chloroethyl phosphate, tris-chlorophenyl phosphate and polyoxyalkylene bis[di(chloroalkyl)] phosphate. Examples of phosphorous ester are dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. It is also possible to use a mixture of these compounds.

These phosphorus compounds may be blended into the refrigerating machine oil of this invention in any desired mixing ratio. However, it is preferable to blend these phosphorus compounds into the lubricating oil in the ratio of 0.01 to 5.0 parts by weight, more preferably 0.02 to 3.0 parts by weight per 100 parts by weight of the lubricating oil.

It is also possible for the purpose of further improving the lubricating oil of this invention in stability to incorporate in the lubricating oil at least one kind of an epoxy compound selected from the group consisting of:

(1) Phenylglycidyl ether type epoxy compounds,
(2) Alkylglycidyl ether type epoxy compounds,
(3) Glycidyl ester type epoxy compounds,
(4) Aryl oxirane compounds,
(5) Alkyl oxirane compounds,
(6) Alicyclic epoxy compounds,
(7) Epoxidized fatty monoesters,
(8) Epoxidized vegetable oils.

Examples of phenylglycidyl ether type epoxy compounds (1) are phenylglycidyl ether and alkylphenylglycidyl ether. The alkylphenylglycidyl ether used herein may be one having 1 to 3 alkyl groups each containing 1 to 13 carbon atoms, preferably one having one alkyl group containing 4 to 10 carbon atoms. Examples of such preferable alkylphenylglycidyl ethers are n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether and decylphenylglycidyl ether.

Examples of alkylglycidyl ether type epoxy compounds (2) are decylglycidyl ether, undecylglycidyl ether, dodecylglycidyl ether, tridecylglycidyl ether, tetradecylglycidyl ether, 2-ethylhexylglycidyl ether, neopentylglycolglycidyl ether, trimethylolpropane triglycidyl ether, pentaerythritol tetraglycidyl ether, 1,6-hexadiol diglycidyl ether, sorbitol polyglycidyl ether, polyalkyleneglycol monoglycidyl ether and polyalkyleneglycol diglycidyl ether.

Examples of glycidyl ester type epoxy compounds (3) are phenylglycidyl ester, alkylglycidyl ester and alkenylglycidyl ester. Preferable examples thereof are glycidyl 2,2-dimethyloctanoate, glycidyl benzoate, glycidyl acrylate and glycidyl methacrylate.

Examples of aryl oxirane compounds (4) are 1,2-epoxystyrene and alkyl-1,2-epoxystyrene.

Examples of alkyl oxirane compounds (5) are 1,2-epoxybutane, 1,2-epoxypentane, 1,2-epoxyhexane, 1,2-epoxyheptane, 1,2- epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,2-epoxyoctadecane, 1,2-epoxynonadecane and 1,2-epoxyeicosane.

Examples of alicyclic epoxy compounds (6) are 1,2-epoxycyclohexane, 1,2-epoxycyclopentane, 3,4-epoxycyclohexylmethyl-3,4-epoxycyclohexane carboxylate, bis(3,4- epoxycyclohexylmethyl) adipate, exo-2,3-epoxynorbornane, bis(3,4-epoxy-6-methylcyclohexylmethyl) adipate, 2-(7-oxabicyclo[4.1.0] hept-3-yl)-spiro(1,3-dioxane-5,3'-[7]oxabicyclo[4.1.0]) heptane, 4-(1'-methylepoxyethyl)-1,2-epoxy-2-methylcyclohexane and 4epoxyethyl-1,2-epoxycyclohexane.

Examples of epoxidized fatty monoesters (7) are an ester formed through a reaction between an epoxidized fatty acid having 12 to 20 carbon atoms and an alcohol having 1 to 8 carbon atoms, phenol or an alkylphenol. In particular, epoxystearates such as butyl, hexyl, benzyl, cyclohexyl, methoxyethyl, phenyl and butylphenyl esters of epoxystearic acid are preferred.

Examples of epoxidized vegetable oils (8) are epoxy compounds of a vegetable oil such as soybean oil, linseed oil or cottonseed oil.

Among these epoxy compounds, phenylglycidyl ether type epoxy compounds, glycidyl ester type epoxy compounds and epoxidized fatty monoester are preferred. Among them, phenylglycidyl ether type epoxy compounds and glycidyl ester type epoxy compounds are more preferred. The most preferable epoxy compounds are phenylglycidyl ether, butylphenylglycidyl ether, alkylglycidyl esters and a mixture thereof.

These epoxy compounds may be blended into the refrigerating machine oil of this invention in any desired mixing ratio. However, it is preferable to blend these epoxy compounds into the oil in the ratio of 0.1 to 5.0 parts by weight, more preferably 0.2 to 2.0 parts by weight per 100 parts by weight of the lubricating oil.

It is also possible, if required, to use singly or jointly suitable conventional additives in the refrigerating machine oil for the purpose of further improving the oil in properties. The suitable conventional additives include anti-oxidants of a phenol type such as di-tert-butyl-p-cresol and bisphenol A or of an amine type such as phenyl-α-naphthyl amine and N,N-di(2-naphthyl)-p-phenylene diamine; wear resistant additives such as zinc dithiophosphate; extreme pressure agents such as chlorinated paraffin and sulfur compounds; oiliness improvers such as a fatty acid; anti-foaming agents such as silicone-type ones; metal inactivators such as benzotriazole; viscosity index improvers; pour point depressants; and detergent-dispersants. These additives may be used singly or in combination. These additives can be generally added in a ratio of not more than 10 parts by weight, more preferably not more than 5 parts by weight, per 100 parts by weight of the lubricating oil.

The pour point of the refrigerating machine oil comprising as a main component a polyoxyalkylene compound or a mixture of polyoxyalkylene compounds according to this invention may be suitably selected as long as the lubricating oil is capable of being useful as a refrigerating machine oil, but it is preferably −10° C. or less, more preferably −20° C. to 80° C. in view of preventing the lubricating oil from being solidified at a low temperature.

The refrigerants used for a refrigerating machine together with the lubricating oil of this invention include an alkane fluoride and/or alkane chlorofluoride having 1 to 3 carbon atoms, preferably 1 to 2 carbon atoms. These refrigerants include HFC such as difluoromethane (HFC-32), trifluoromethane (HFC-23), pentafluoroethane (HFC-125), 1,1,2,2-tetrafluoroethane (HFC-134), 1,1,2,2-tetrafluoroethane (HFC-134a), 1,1,1-trifluoroethane (HFC-143a) and 1,1-difluoroethane (HFC-152a), HCFC such as monochloro difluoromethane (HCFC-22), 1-chloro-1,1-difluoroethane (HCFC-142b), dichloro trifluoroethane (HCFC-123) and monochloro tetrafluoroethane (HCFC-124), CFC such as trichloro monofluoromethane (CFC-11), dichloro difluoromethane (CFC-12), monochloro trifluoromethane (CFC-13) and monochloro pentafluoroethane (CFC-115) and a mixture of two or more kinds of them. However, in view of environmental problems, it is preferable to use HFC and/or HCFC, especially HFC such as HFC-32, HFC-23, HFC-125, HFC-134, HFC-134a, HFC-143a and HFC-152a. These HFC refrigerants are suitably selected according to their usage and demanded performance, and useful examples of these HFC are HFC-134a alone, HFC-125 alone, a mixture of HFC-134a/HFC-32 in a ratio of 60–80% by weight/40–20% by weight, a mixture of HFC-125/HFC-32 in a ratio of 30–60% by weight/70–40% by weight, a mixture of HFC-125/HFC-143a in a ratio of 40–60% by weight/60–40% by weight, a mixture of HFC-134a/HFC-32/HFC-125 in a ratio of 60% by weight/30% by weight/10% by weight, a mixture of HFC-134a/HFC-32/HFC-125 in a ratio of 40–70% by weight/15–35% by weight/5–40% by weight and a mixture of HFC-125/HFC-134a/HFC-143a in a ratio of 35–55% by weight/1–15% by weight/40–60% by weight.

Specific examples of the HFC refrigerant mixtures are a mixture of HFC-134a/HFC-32 in a ratio of 70% by weight/30% by weight; a mixture of HFC-32/HFC-125 in a ratio of 60% by weight/40% by weight; a mixture of HFC-32/HFC-125 in a ratio of 50% by weight/50% by weight (R410A; trade name: Genetron AZ-20, a product of Allied-Signal Inc.); a mixture of HFC-32/HFC-125 in a ratio of 45% by weight/55% by weight (R410B; trade name: SUVA AC9100, a product of E. I. Dupont de Nemours and Company); a mixture of HFC-125/HFC-143a in a ratio of 50% by weight/50% by weight (R507C; trade name: Genetron AZ-50, a product of Allied-Signal Inc.); a mixture of HFC-32/HFC-125/HFC-134a in a ratio of 30% by weight/10% by weight/60% by weight; a mixture of HFC-32/HFC-125/HFC-134a in a ratio of 23% by weight/25% by weight/52% by weight (R407C; trade name: SUVA AC9000, a product of E. I. Dupont de Nemours and Company); a mixture of HFC-125/HFC-134a/HFC-143a in a ratio of 44% by weight/4% by weight/52% by weight (R404A; trade name: SUVA HP-62, a product of E. I. Duppont de Nemours and Company).

The lubricating oil of this invention is generally present in a refrigerating machine as a composition in which the lubricating oil is mixed with an alkane fluoride and/or alkane chlorofluoride refrigerant as mentioned above. The mixing ratio between the lubricating oil and the refrigerant in this composition may be optionally determined, but is generally a ratio of 1 to 500 parts by weight, preferably 2 to 400 parts by weight, of the lubricating oil, per 100 parts by weight of the refrigerant.

Since the lubricating oil of this invention is excellent in electric characteristics and low in hygroscopicity, it is particularly suited for use in a refrigerating machine wherein an alkane fluoride and/or alkane chlorofluoride is used as a refrigerant, such as an air conditioner or a refrigerator provided with a sealed compressor of a reciprocating type or rotary type. This lubricating oil is also suited for use in a refrigerating machine wherein the refrigerant is used, such as an automatic air conditioner, a dehumidifier, a freezer, a freeze and refrigeration warehouse, an automatic vending machine, a show-case or a cooling system for a chemical plant. This lubricating oil is also applicable to a refrigerating machine provided with a compressor of a centrifugal type.

DESCRIPTION OF THE PREFERRED EMBODIMENTS

This invention will be further explained with reference to the following examples and comparative examples. However, it should be noted that these examples are not intended to restrict in any manner the scope of this invention.

First, methods for manufacturing the lubricating oils employed in Examples 1 to 5 as well as in Comparative Examples 1 to 3 will be explained as follows.

Synthesis Example 1

0.84 g (0.015 mol) of potassium hydroxide and 58.3 g (0.3 mol) of methyl-α-D-glucoside were introduced into a 300-ml stainless steel autoclave equipped with a stirrer, an inlet tube and a manometer, and then hermetically closed. Then, after the interior of the autoclave was somewhat decompressed, all of 173.1 g (2.4 mol) of 1,2-butylene oxide was introduced into the autoclave through suction. The contents of the autoclave were then gradually raised in temperature under stirring to react them together for 15 hours at a temperature of 120° C.

A 1,000-ml four-neck flask equipped with a stirrer, a reflux condenser and a thermometer was charged with 77 g of the reaction product obtained by the above reaction, 180 g of sodium hydroxide and 160 ml of pure water, and then the resultant mixture was fully stirred. Then, 116.3 g (0.8 mol) of methyl iodide, 9.67 g (0.03 mol) of tetrabutyl ammonium bromide as a phase-transfer catalyst and 300 ml of toluene as a solvent were added to the mixture, and the whole was allowed to react for 20 hours at a temperature of 40° C., thereby methyl-etherifying the terminal hydroxyl group(s) of the above-mentioned reaction product.

The whole contents in the flask were transferred to a 1,000-ml separating funnel, incorporated with 200 ml of toluene and then washed five times with pure water, each with 250 ml of pure water. Subsequently, the resulting toluene solution was separated, dehydrated and then freed from the solvent under the conditions of 120° C. and 1 mmHg or less to obtain a liquid. The liquid so obtained was treated with a low temperature-activated clay for 30 minutes at a temperature of 60° C. Finally, the liquid so treated was freed from the activated clay to obtain 80 g of a mixture of polyoxyalkylene compounds according to this invention as a colorless transparent liquid.

Synthesis Example 2

The procedure of Synthesis Example 1 was followed except that the amount of 1,2-butylene oxide added was changed to 129.8 g (1.8 mol), thereby obtaining 75 g of a mixture of polyoxyalkylene compounds according to this invention as a colorless transparent liquid.

Synthesis Example 3

The procedure of Synthesis Example 1 was followed except that the amount of 1,2-butylene oxide added was changed to 216.3 g (3.0 mol), thereby obtaining 88 g of a mixture of polyoxyalkylene compounds according to this invention as a colorless transparent liquid.

Synthesis Example 4

0.84 g (0.015 mol) of potassium hydroxide and 43.8 g (0.3 mol) of isosorbide (1,4-3,6-sorbide) were introduced into the same autoclave as used in Synthesis Example 1, and then hermetically closed therein. Then, after the interior of the autoclave was somewhat decompressed, 194.7 g (2.7 mol) of 1,2-butylene oxide were all introduced into the autoclave through suction. The contents of the autoclave were gradually raised in temperature to 120° C. under stirring and allowed to react at this temperature for 15 hours.

The same four-neck flask as used in Synthesis Example 1 was charged with 80 g of the reaction product obtained by the above reaction, 180 g of sodium hydroxide and 160 ml of pure water, and the resultant mixture was then fully stirred. Then, 56.8 g (0.4 mol) of methyl iodide, 9.67 g (0.03 mol) of tetrabutyl ammonium bromide as a phase-transfer catalyst and 300 ml of toluene as a solvent were added to the mixture, and the whole was allowed to react at a temperature of 40° C. for 24 hours, thereby methyl-etherifying the terminal hydroxyl group(s) of the above-mentioned reaction product.

The whole contents in the flask was transferred to a 1,000-ml separating funnel, incorporated with 200 ml of toluene and then washed five times with pure water, each with 250 ml of pure water. Subsequently, the resulting toluene solution was separated, dehydrated and then freed from the solvent under the conditions of 120° C. and 1 mmHg or less. The resultant liquid thus obtained was treated with a low temperature-activated clay at a temperature of 60° C. for 30 minutes. Finally, the clay was separated from the liquid to obtain 79 g of a mixture of polyoxyalkylene compounds according to this invention as a colorless transparent liquid.

Synthesis Example 5

The prodedure of Synthesis Example 4 was followed except that the amount of 1,2-butylene oxide added was changed to 173.1 g (2.4 mol), thereby obtaining 72 g of a mixture of polyoxyalkylene compounds according to this invention as a colorless transparent liquid.

Synthesis Example 6

61.36 g (0.87 mol) of potassium methoxide were introduced into a 1,000-ml stainless steel autoclave equipped with a stirrer, an inlet tube and a manometer, and then hermetically closed therein. Then, 300 ml of toluene as a solvent were introduced into the autoclave and the resultant solution was heated to 120° C. with stirring. Then, 504.8 g (7.0 mol) of 1,2-butylene oxide were pressure introduced via the inlet tube over a period of 6 hours, for effecting its reaction with said methoxide therein. Further, 184.5 g (1.3 mol) of methyl iodide were introduced into the autoclave via the inlet tube without opening the autoclave and then hermetically closed therein, after which the resultant mixture was gradually raised in temperature to 90° C. with stirring in order to react the mixture at this temperature for 3 hours.

Then, the autoclave was opened, and the whole contents in the autoclave was transferred to a 2,000-ml separating funnel using 500 ml of toluene and washed five times with pure water, each with 500 ml of pure water. Subsequently, the resulting toluene solution was separated and dehydrated, and the solution so dehydrated was then freed from the solvent and light-fraction ingredients under the conditions of 120° C. and 1 mmHg or less. The liquid thus obtained was treated with a low temperature-activated clay at a temperature of 60° C. for 30 minutes. Finally, the clay was separated from the liquid to obtain 530 g of compounds consisting mainly of dimethyl ether of polyoxybutylene glycol as a colorless transparent liquid.

Synthesis Example 7

The procedure of Synthesis Example 1 was followed except that there was not effected the methyl-etherification of the terminal hydroxyl groups of the reaction product by reacting methyl iodide with the reaction product in the presence of the phase-transfer catalyst, thereby obtaining 75 g of a mixture of polyoxyalkylene compounds having methyl-α-D-glucoside as the terminal group(s), the mixture being in the form of a colorless transparent liquid.

Synthesis Example 8

The procedure of Synthesis Example 1 was followed except that 139.4 g (2.4 mol) of propylene oxide were substituted for the 173.1 g (2.4 mol) of 1,2-butylene oxide, thereby to obtain 78 g of a mixture of polyoxyalkylene compounds as a colorless transparent liquid.

Examples 1 to 5 and Comparative Examples 1 to 4

The following tests were conducted using as test oils the polyoxyalkylene compounds (Examples 1 to 5) according to this invention which had been obtained in the Synthesis Examples 1 to 5, the polyoxyalkylene compounds (Comparative Examples 1 to 3) falling outside the scope of this invention which had been obtained in the Synthesis Examples 6 to 8 and polypropylene glycol dimethyl ether (Comparative Example 4) available in the market, respectively. The properties of these test oils and the results of the tests are shown in Table 1.

(Temperature for causing two-layer separation at a high temperature when used with HFC-134a)

0.15 g of the test oil obtained from each of the Examples and Comparative Examples were introduced into a 10-ml pressure resistant glass tube, and then 4.85 g of a refrigerant (HFC-134a) were introduced into the glass tube {refrigerant: test oil=100:3.1(parts by weight)}. Then, each glass tube was put into a thermostat kept at a prescribed temperature to see if the refrigerant and the test oil were dissolved in each other or if they were separated from each other or turned white-turbid, at a prescribed temperature. (Temperature for causing two-layer separation at a low temperature when used with HFC-134a)

In conformity with JIS K 2211 4.12, 5 g of the test oil obtained from each of the Examples and Comparative Examples and 20g of a refrigerant (HFC-134a) {refrigerant: test oil=100:25 (parts by weight)} were used to see if the refrigerant and the test oil were dissolved in each other or if they were separated from each other or turned white-turbid, at a prescribed temperature.

(Volume resistivity)

In conformity with JIS C 2101, each of the test oils was measured for its volume resistivity at a temperature of 25° C.

TABLE 1

| | Ex. 1 | Ex. 2 | Ex. 3 | Ex. 4 | Ex. 5 | Comp. Ex. 1 | Comp. Ex. 2 | Comp. Ex. 3 | Comp. Ex. 4 |
|---|---|---|---|---|---|---|---|---|---|
| Test oil | Synthesis Ex. 1 | Synthesis Ex. 2 | Synthesis Ex. 3 | Synthesis Ex. 4 | Synthesis Ex. 5 | Synthesis Ex. 6 | Synthesis Ex. 7 | Synthesis Ex. 8 | Polypropylene glycol dimethyl ether |
| Kinematic viscosity ($mm^2/s$) 40° C. | 59.3 | 51.9 | 74.1 | 52.5 | 50.6 | 39.6 | 1210 | 41.4 | 39.5 |
| Kinematic viscosity ($mm^2/s$) 100° C. | 8.30 | 7.11 | 9.93 | 8.03 | 7.81 | 7.82 | 33.7 | 7.81 | 8.99 |
| Viscosity index | 110 | 93 | 115 | 122 | 121 | 173 | 7 | 136 | 219 |
| $a \cdot l + b \cdot m$ (Average)* | 7.27 | 5.19 | 9.22 | 8.17 | 7.19 | — | 7.22 | 8.93 | — |
| $l + m + n$ | 5 | 5 | 5 | 2 | 2 | — | 5 | 5 | — |
| $p/(p + q)$ | 1 | 1 | 1 | 1 | 1 | 1 | 1 | 0 | 0 |

TABLE 1-continued

| | Ex. 1 | Ex. 2 | Ex. 3 | Ex. 4 | Ex. 5 | Comp. Ex. 1 | Comp. Ex. 2 | Comp. Ex. 3 | Comp. Ex. 4 |
|---|---|---|---|---|---|---|---|---|---|
| Mn | 822 | 678 | 966 | 820 | 748 | 920 | 766 | 822 | 900 |
| Mw/Mn | 1.1 | 1.2 | 1.1 | 1.1 | 1.2 | 1.1 | 1.1 | 1.2 | 1.1 |
| Hydroxyl value (mgKOH/g) | 1.5 | 0.5 | 2.7 | 1.0 | 2.1 | 1.8 | 293 | 2.7 | 1.2 |
| Temp. for two-layer separation (°C.) High temp. causing | >70 | >70 | >70 | >70 | >70 | 53 | 65 | >70 | >70 |
| Low temp. | <−70 | <−70 | <−70 | −30 | −39 | insoluble at room temp. | <−70 | <−70 | <−70 |
| Volume resistivity (Ω cm) | $1.8 \times 10^{12}$ | $4.7 \times 10^{12}$ | $8.9 \times 10^{12}$ | $6.3 \times 10^{12}$ | $5.5 \times 10^{12}$ | $5.8 \times 10^{12}$ | $1.5 \times 10^{8}$ | $3.7 \times 10^{8}$ | $2.4 \times 10^{8}$ |

*Value obtained by calculation from number-average mol. wt. (Mn) of polyoxyalkylene compound.

As is apparent from the test results of the oils of Examples and Comparative Examples shown in Table 1, the polyoxyalkylene compounds according to this invention obtained from Examples 1 to 5 are soluble in a HFC refrigerant over a wide range of temperature, and also indicate excellent electric characteristics.

In contrast, the oil of Comparative Example 1 which consists mainly of dimethyl ether of polyoxybutylene glycol indicates excellent electric characteristics, but it is very poor in compatibility with a HFC refrigerant as compared with a polyoxyalkylene compounds according to this invention. On the other hand, the compound of Comparative Example 2 (the hydroxyl value thereof falling outside the scope of this invention) in which the terminal hydroxyl group(s) were not methyl-etherified, the compound of Comparative Example 3 (the value of p/(p+q) falling outside the scope of this invention) which was obtained by substituting propylene oxide for the butylene oxide and the compound of Comparative Example 4 which is polypropylene glycol dimethyl ether available in the market, each indicate excellent compatibility with a HFC refrigerant, but they are each very inferior in electric characteristics to the polyoxyalkylene compounds according to this invention.

As explained above, the refrigerating machine oil of this invention which contains as a main component at least one polyoxyalkylene compound of a specific structure is soluble in an alkane fluoride refrigerant such as HFC-134a or an alkane chlorofluoride refrigerant over a wide range of temperature, and it is aslo excellent in electric characteristics and, moreover, can hardly be hydrolyzed.

Therefore, the lubricating oil of this invention is very useful for use together with an alkane fluoride and/or alkane chlorofluoride as a refrigerating machine oil. When the refrigerating machine oil of this invention is mixed with an alkane fluoride and/or alkane chlorofluoride, there is obtained a composition of this invention for refrigerating machines which is capable of maintaining stable compatibility for a long period of time, excellent in electric characteristics and free from the generation of acids by hydrolysis.

The refrigerating machine oil of this invention will not cause an electrical leakage even if it is used in a closed-type compressor having a structure in which a refrigerating machine oil is allowed to contact with an electrode, and will not generate an acid by its hydrolysis thereby to fully prevent it from corrosion by the acid. Therefore, when the refrigerating machine oil of this invention is used as a lubricating oil in a refrigerating machine in which an alkane fluoride and/or alkane chlorofluoride is used as a refrigerant, it will enable the refrigerating machine to continue a stable operation for a long period of time without causing an electric leakage, corrosion by an acid, or the like.

What is claimed is:

1. A lubricating oil for a refrigerating machine comprising:

as a main component at least one compound selected from the group consisting of polyoxyalkylene compounds represented by the following general formula (I);

$$A \left\langle \begin{array}{l} \{O-(R^1O)_a-R^3\}_l \\ \{O-(R^2O)_b-H\}_m \\ \{O-R^4\}_n \end{array} \right.$$

wherein A represents a residue obtained by eliminating hydroxyl groups from cyclic glucose; $R^1$ and $R^2$ are identical with or different from each other and are each an alkylene group having from 2 to 6 carbon atoms; $R^3$ is an alkyl group having from 1 to 6 carbon atoms; $R^4$ is a methyl group; a and b are each a positive integer and l and m are each an integer of 0 or more and n is 1 with the proviso that $a \cdot l + b \cdot m = 2$ to 100 and $l+m+n=5$; further (a) said main component has a hydroxyl value ranging from 0 mgKOH/g to 30.0 mgKOH/g and (b) a ratio of butylene groups of all alkylene groups represented by $R^1$ and $R^2$ in said general formula (1) to said all alkylene groups satisfies the following formula (1)

$$0.5 \leqq p/(p+q) \leqq 1.0 \quad (1)$$

wherein p is the number of butylene groups, q is the number of alkylene groups having from 2 to 6 carbon atoms excluding the butylene groups.

2. A composition for a refrigerating machine comprising a mixture of:

(A) a lubricating oil for a refrigerating machine as defined in claim 1 and (B) at least one member chosen from the group consisting of an alkane fluoride and an alkane chlorofluoride.

3. A lubricating oil as defined in claim 1 wherein p/(p+q) is in a range of 0.7 to 1.0.

4. A lubricating oil as defined in claim 1 wherein p/(p+q) is in a range of 0.8 to 1.0.

5. A lubricating oil as defined in claim 1 wherein p/(p+q) is 1.0.

6. A lubcating oil as defined in claim 1, wherein said main component has a hydroxyl value ranging from 0.5 to 2.7 mgKOH/g.

7. A lubricating oil according to claim 1 wherein $R^3$ is a methyl group.

8. A lubricating oil for a refrigerating machine comprising: as a main component at least one compound selected from the group consisting of polyoxyalkylene compounds represented by the following general formula (I);

$$A\left\langle\begin{array}{l}\{O-(R^1O)_a-R^3\}_l\\ \{O-(R^2O)_b-H\}_m\\ \{O-R^4\}_n\end{array}\right.$$

wherein A represents a residue obtained by eliminating hydroxyl groups from isosorbide; $R^1$ and $R^2$ are identical with or different from each other and are each an alkylene group having from 2 to 6 carbon atoms; $R^3$ is an alkyl group having from 1 to 6 carbon atoms; $R^4$ is hydrogen atom or an alkyl group having from 1 to 6 carbon atoms; a and b are each a positive integer and l, m and n are each an integer of 0 or more with the proviso that $a \cdot l + b \cdot m = 2$ to 100 and $l+m+n=2$; further (a) said main component has a hydroxyl value ranging from 0 mgKOH/g to 30.0 mgKOH/g and (b) a ratio of butylene groups of all alkylene groups represented by $R^1$ and $R^2$ in said general formula (I) to all said alkylene groups satisfies the following formula (1)

$$0.5 \leqq p/(p+q) \leqq 1.0 \quad (1)$$

wherein p is the number of butylene groups, q is the number of alkylene groups having from 2 to 6 carbon atoms excluding the butylene groups.

9. A composition for a refrigerating machine comprising a mixture of:

(A) a lubricating oil for a refrigerating machine as defined in claim 8 and (B) at least one of an alkane fluoride and an alkane chlorofluoride.

* * * * *